US005351613A

United States Patent [19]

Newsom

[11] Patent Number: 5,351,613

[45] Date of Patent: Oct. 4, 1994

[54] APPARATUS FOR ADJUSTING A FIXED KNIFE IN RAM BALERS

[75] Inventor: Horace R. Newsom, Waco, Tex.

[73] Assignee: Harris Waste Management Group, Inc., Peachtree City, Ga.

[21] Appl. No.: 30,792

[22] Filed: Mar. 12, 1993

Related U.S. Application Data

[63] Continuation-in-part of Ser. No. 998,468, Dec. 30, 1992.

[51] Int. Cl.[5] ..... B30B 9/30

[52] U.S. Cl. ..... 100/98 R; 100/179

[58] Field of Search ..... 100/96, 98 R, 179, 188 R

[56] References Cited

U.S. PATENT DOCUMENTS

| | | | |
|---|---|---|---|
| 2,811,100 | 10/1957 | Lindemann | 100/98 R |
| 3,003,411 | 10/1961 | Judd | 100/98 R |
| 3,613,556 | 10/1971 | Wright et al. | 100/98 R X |
| 5,007,337 | 4/1991 | Newsom | 100/188 R |
| 5,081,922 | 1/1992 | Rudd, Jr. et al. | 100/50 |
| 5,247,881 | 9/1993 | Rosser et al. | 100/98 R X |

FOREIGN PATENT DOCUMENTS

| | | | |
|---|---|---|---|
| 123066 | 5/1931 | Austria | 100/98 R |
| 734595 | 4/1943 | Fed. Rep. of Germany | 100/98 R |
| 1779153 | 3/1974 | Fed. Rep. of Germany | 100/98 R |

*Primary Examiner*—Stephen F. Gerrity
*Attorney, Agent, or Firm*—Kirkpatrick & Lockhart

[57] ABSTRACT

A ram baler (20) having a compression ram (28) with plunger (29) and platen (31). A fixed knife assembly (50) with a first cutting edge (52) is attached to the ram baler (20) and a second cutting edge (42) is attached to the compression ram (28). Platen (31) includes a movable knife assembly (40) for attachment of the second cutting edge (42). The fixed knife assembly (50) includes a pair of adjusting assemblies (80) which allow adjustment of the vertical spacing between the first cutting edge (52) and the second cutting edge (42). This adjustment can be accomplished without disassembly of the components of the ram baler (20).

20 Claims, 2 Drawing Sheets

FIG. 1
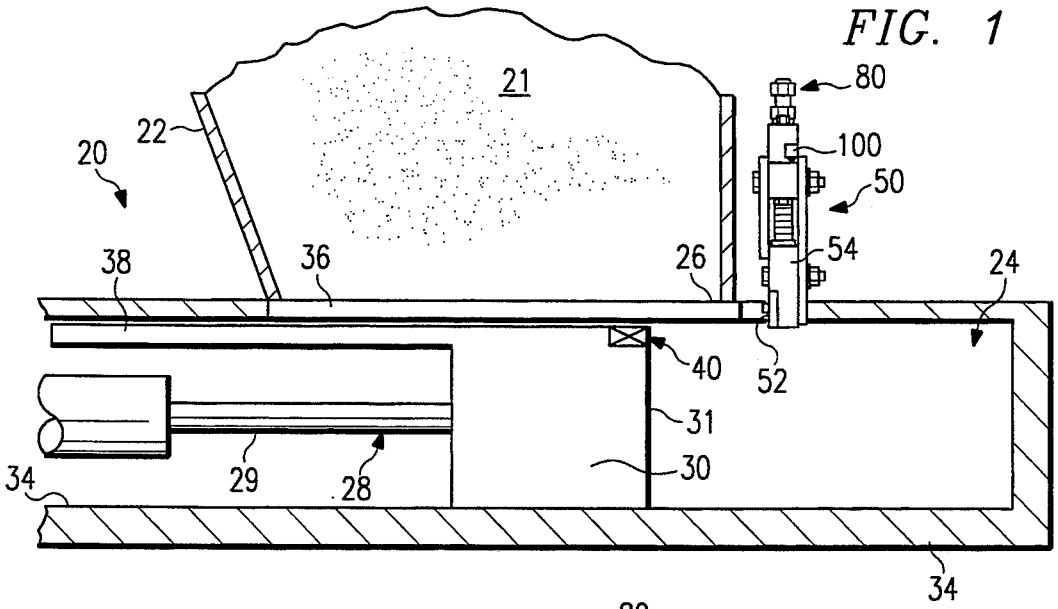
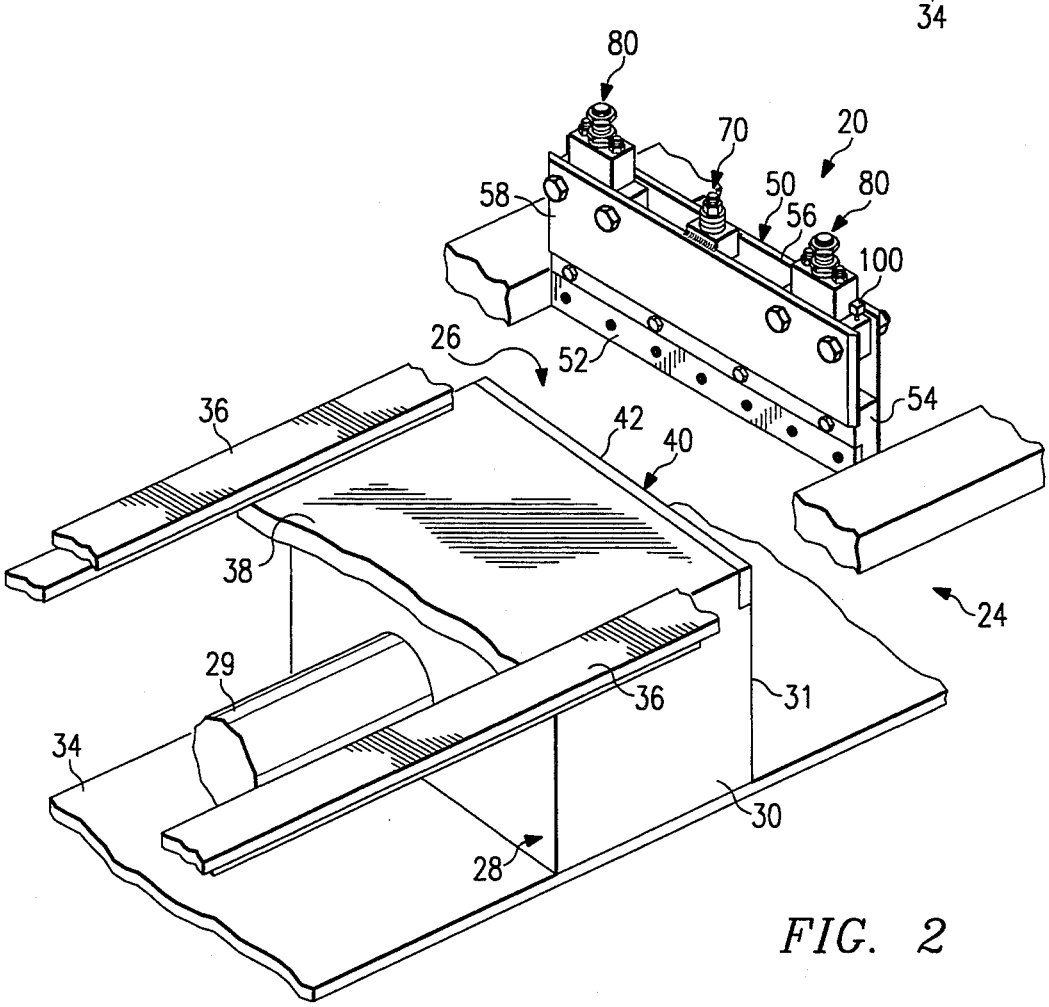
FIG. 2

APPARATUS FOR ADJUSTING A FIXED KNIFE IN RAM BALERS

RELATED APPLICATION

This application is a continuation-in-part application based on copending patent application Ser. No. 07/998,468 filed December 3, 1992 entitled "Method and Apparatus for Adjusting Ram Baler Platen" (pending).

TECHNICAL FIELD OF THE INVENTION

The present invention relates generally to devices for baling material such as trash or recyclable products, and more specifically relates to improvements in multiple ram balers for forming and ejecting bales of such material.

BACKGROUND OF THE INVENTION

Balers, specifically two ram balers, are commonly used to compress recyclable products or waste material such as aluminum cans and the like into bales and then to strap the bales in order to facilitate transportation of the materials. Examples of such two ram balers are described in U.S. Pat. No. 5,007,337, entitled "Oversize Bale Release Mechanism For Waste Material Baler" and U.S. Pat. No. 5,081,922, entitled "Device for Controlling the Discharge of a Bale from a Solid Waste Baling Machine." These balers generally comprise a hopper for storing and feeding the material to be baled and a baling chamber in which the bale is formed. A main compression ram comprising a hydraulic plunger and platen is operated within the chamber to compress the material into the shape of the bale, and a smaller ram ejects the bale into the strapping device.

Two knives or cutting edges are often used in order to separate the material in the hopper from the material in the baling chamber. One such cutting edge, the first or fixed cutting edge, is frequently attached to the top of the baling chamber adjacent where the material enters the baling chamber from the hopper. The other cutting edge, the second or movable cutting edge, is frequently attached to the top of the platen. As the hydraulic plunger extends, the top of the platen moves underneath the top of the baling chamber. Consequently, the two cutting edges meet in a scissor-type action to cut and separate material in the hopper from material in the baling chamber. It is very important for satisfactory operation of the baler to maintain minimum vertical clearance or spacing between the first and second cutting edges.

Problems arise during normal operation of the baler as various components wear, and the distance between the two cutting edges increases. As this distance increases, the cutting efficiency is reduced, much like the cutting efficiency of scissors is reduced if the connecting rivet loosens. As the cutting efficiency is reduced, total separation of the material is not accomplished. Damage to the baler may occur from forces such as those associated with the main compression ram tearing the material rather than cutting the material.

This problem has been previously solved in several ways. One technique is an adjustable top for the ceiling of the baling chamber. The top of the baling chamber is placed on shims and secured with bolts. As the bottom surface of the platen or other components wear, thus increasing the distance between the two cutting edges, the top of the baling chamber may be disassembled. A number of shims are removed to reestablish the desired vertical clearance between the two cutting edges and the top of the chamber reinstalled. Another method is to install shims underneath the floor of the baling chamber. As the bottom surface of the platen or other components wear, the number of shims is increased, thereby raising the platen and its associated cutting edge to reestablish the desired vertical clearance.

One problem with both of the above methods is that it takes substantial time and effort to disassemble the proper parts of the baler at the proper time, change the required number of shims, and then reassemble the parts of the baler. Another problem with the prior methods is that the baler operator is often not qualified to perform the required adjustments. Professional service help must then be called resulting in more down time for the baler. Even where operators are qualified to perform the adjustments, the time and effort required often results in the operators neglecting to readjust the vertical distance between the cutting edges when necessary. This neglect may result in inefficient baling or damage to the baler.

SUMMARY OF THE INVENTION

In accordance with the present invention, a ram baler is provided which substantially eliminates or reduces disadvantages and problems associated with prior ram balers.

A ram baler of the present invention includes a platen coupled to a hydraulic plunger, a first, fixed knife assembly attached to the baler and a second, movable knife assembly attached to the platen. When the vertical clearance between the first cutting edge of the fixed knife assembly and the second cutting edge of the movable knife assembly increases due to normal wear from operation of the baler, the fixed knife assembly allows repositioning the first cutting edge to obtain the desired vertical clearance with respect to the second cutting edge.

In a more specific aspect of the invention, the fixed knife assembly includes a first and a second support plate with a knife carrier and associated cutting edge secured there between. The fixed knife assembly includes means for adjusting the vertical position of the knife carrier relative to the support plates. The adjusting means includes a hanger assembly disposed between the first and second support plates with a hanger rod or bolt engaged with the knife carrier. A pair of adjusting beams are disposed between the first and second support plates on opposite sides of the hanger assembly An adjusting screw or rod extends from each adjusting beam and contacts the knife carrier.

Another aspect of the present invention is that the hanger assembly and its associated hanger rod limit the vertical movement of the knife carrier relative to the first and second support plates. The adjusting beams are secured with bolts which are selected to shear if the forces exerted on the knife carrier exceed a preselected value.

A significant technical advantage of the present invention results from the fixed knife assembly allowing adjusting of the vertical clearance between the first cutting edge and the second cutting edge without requiring disassembly of the various components of the baler. The vertical clearance between the first cutting edge and the second cutting edge may be easily adjusted to the desired optimum value by the movement of adjusting screws carried by the fixed knife assembly.

Another significant technical advantage of the present invention is that the adjusting assembly used to position the knife carrier also includes as a safety shut down mechanism. If the forces applied to the knife carrier exceed a preselected value during operation of the baler, safety devices are provided within the fixed knife assembly which will shear prior to any damage being caused to other components of the baler. For example, if force above a preselected value is exerted on the knife carrier by the hydraulic plunger and its associated platen, the adjusting beam will be released from its fixed position to activate a limit switch which will stop the operation of the baler.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is a schematic drawing, in elevation and section with portions broken away, showing a ram baler with an adjustable fixed knife assembly incorporating the present invention;

FIG. 2 is an isometric drawing with portions broken away of the ram baler of FIG. 1;

DETAILED DESCRIPTION OF THE INVENTION

Figure 3:
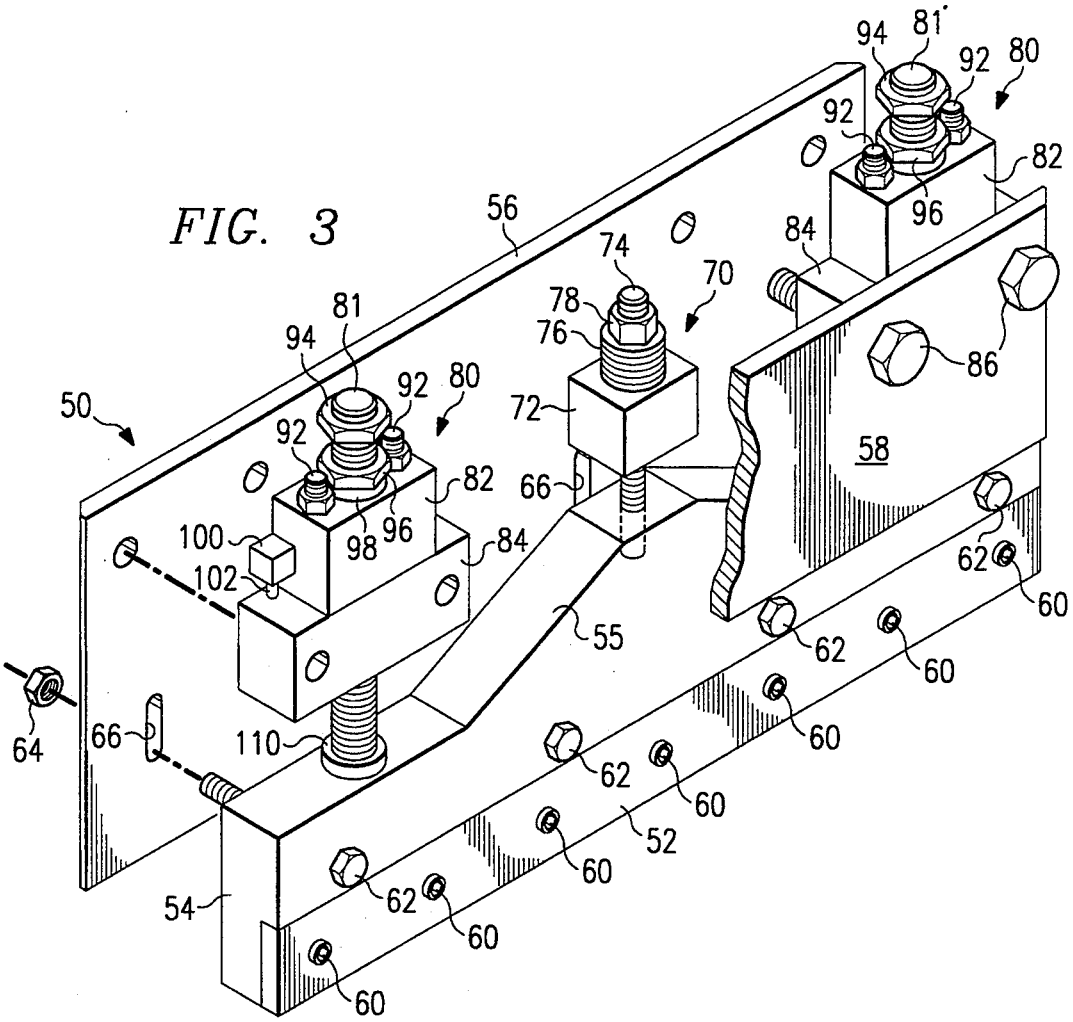
FIG. 3 is an isometric drawing with portions broken away showing an adjustable fixed knife assembly incorporating the present invention for use with the ram baler of FIG. 1.

The preferred embodiment of the present invention and its advantages are best understood by referring to FIGS. 1–4 of the drawings, like numerals being used for like and corresponding parts of the various drawings.

FIGS. 1 and 2 show ram baler 20 having adjustable fixed knife assembly 50 in accordance with the invention. FIG. 1 shows a side view of ram baler 20 and its main compression ram 28. Ram baler 20 preferably includes a smaller ejecting ram (not shown). Therefore, ram baler 20 is often referred to as a two ram baler.

Material 21 is loaded into hopper 22 and fed by gravity into baling chamber 24 through baling chamber opening 26. Compression ram 28 includes hydraulic plunger 29, ram head 30 and platen 31. Hydraulic plunger 29 is provided to move ram head 30 and platen 31 back and forth within chamber 24. On its forward motion, platen 31 compresses material 21 inside baling chamber 24. As platen 31 is retracted by plunger 29, additional material 21 from hopper 22 will fall into chamber 24 and the cycle is repeated until chamber 24 is filled with a compressed bale. The ejecting ram (not shown) is used to remove the compressed bale from chamber 24. Compression ram 28 also carries movable knife assembly 40 on ram head 30 adjacent to platen 31.

When chamber 24 is almost full, excess material 21 will pile up and this pile will extend into hopper 22 through baling chamber opening 26. This excess material 21 is preferably cut or separated by the scissor-like action of first cutting edge 52 of fixed knife assembly 50 and second cutting edge 42 of movable knife assembly 40, as platen 31 moves into baling chamber 24.

Floor 34 of ram baler 20 supports ram head 30 and platen 31 as they slide back and forth. Holding bars 36 prevent ram head 30 and platen 31 from "riding up" above the level of holding bars 36. Examples of two ram balers are shown in U.S. Pat. Nos. 5,007,337 and 5,081,922. These patents are incorporated by reference for all purposes within this application.

FIG. 2 is a partial isometric view of compression ram 28 and its interface with fixed knife assembly 50. First cutting edge 52 is secured to knife carrier 54 within fixed knife assembly 50. Movable knife assembly 40 with second cutting edge 42 is secured to the top portion of platen 31. Main compression ram 28 includes roof plate assembly 38 which blocks opening 26 as platen 31 moves into chamber 24.

Figure 4:
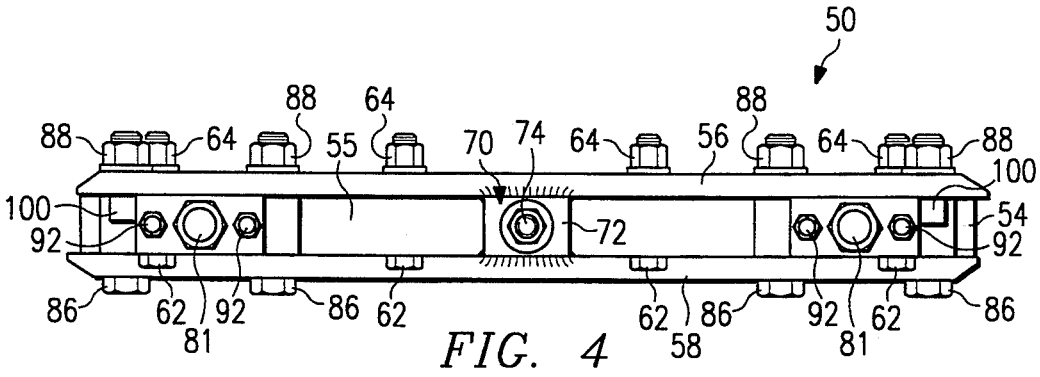
FIG. 4 is a plan view of the adjustable fixed knife assembly of FIG. 3.

During the reciprocating motion of compression ram 28, various components such as floor 34 and/or the bottom of ram head 30 and platen 31 will wear resulting in the vertical spacing between first cutting edge 52 and second cutting edge 42 increasing. As this vertical distance increases beyond the desired operating range for efficient operation of ram baler 20, it is necessary to adjust the position of first cutting edge 52 and second cutting edge 42 relative to each other. As best shown in FIGS. 3 and 4, fixed knife assembly 50 comprises means for adjusting the vertical spacing of first cutting edge 52 relative to second cutting edge 42.

Fixed knife assembly 50 includes first support plate 56 and second support plate 58. Depending upon the specific design of ram baler 20, various mounting brackets, frames or other types of supporting structure may be used to anchor fixed knife assembly 50 adjacent to opening 26 in ram baler 20. The various types of supporting brackets and frames are not shown in the drawings. The ends of support plates 56 and 58 are beveled so that support plates 56 and 58 may be directly welded to ram baler 20, if desired.

As shown in FIG. 2, fixed knife assembly 50 is preferably positioned at an acute angle relative to compression ram 28 and movable knife assembly 40. By anchoring fixed knife assembly 50 at such an angle relative to the longitudinal axis of compression ram 28, the cutting efficiency of first cutting edge 52 and second cutting edge 42 is substantially improved. Fixed knife assembly 50 may be positioned normal to the longitudinal axis of compression ram 28. However, the cutting action of first cutting edge 52 and second cutting edge 42 are substantially improved by anchoring fixed knife assembly 50 at an acute angle relative to the longitudinal axis of compression ram 28.

First cutting edge 52 is secured to the lower portion of knife carrier 54 facing platen 31 as shown in FIG. 2. A plurality of bolts 60 are used to secure first cutting edge 52 to knife carrier 54. Knife carrier 54 is releasably secured to first support plate 56 by a plurality of bolts 62 and their associated nuts 64. If first cutting edge 52 should experience excessive wear or become damaged during operation of baler 20, first cutting edge 52 may be easily removed from knife carrier 54 without requiring disassembly of fixed knife assembly 50.

A plurality of slots 66 are formed in first support plate 56 to receive bolts 62. Slots 66 cooperate with their associated bolts 62 to allow limited vertical movement of knife carrier 54 and first cutting edge 52 relative to support plates 56 and 58. This vertical movement allowed by slots 66 is used to adjust the position of knife carrier 54 to maintain the desired vertical spacing between first cutting edge 52 and second cutting edge 42.

Fixed knife assembly 50 includes hanger assembly 70 which is used to releasably secure knife carrier 54 between support plates 56 and 58 in cooperation with bolts 62 and slots 66. Hanger assembly 70 preferably includes hanger beam 72 positioned between support plates 56 and 58 intermediate the ends thereof. Hanger beam 72 is preferably welded near the top of support plates 56 and 58. The attachment of hanger beam 72 with support plates 56 and 58 is best shown in FIGS. 2 and 4.

For ease of manufacture and assembly and to increase the strength of both knife carrier 54 and hanger assembly 70, raised portion 55 having the general configuration of a trapezoid is provided on the upper portion of knife carrier 54 for attachment to hanger assembly 70. Hanger bolt 74 extends through an opening in hanger beam 72 and is engaged with a threaded opening in raised portion 55. The opening in hanger beam 72 is sized to allow unrestricted vertical movement of hanger bolt 74. A plurality of spring washers 76 along with nut 78 are positioned on the portion of hanger bolt 74 which extends upwardly through hanger beam 72. Nut 78 provides a first shoulder on the exterior of hanger bolt 74 to trap spring washers or biasing means 76 between the first shoulder and hanger beam 72. Spring washers 76 cooperate with hanger bolt 74 and slots 66 to allow limited vertical movement of knife carrier 54 between support plates 56 and 58 without requiring disassembly or removal of nut 78 from bolt 74 or nuts 64 from bolts 62.

A pair of adjusting assemblies 80 with their respective adjusting screws 81 are disposed between support plates 56 and 58 on opposite sides of hanger assembly 70. As will be explained later in more detail, adjusting screws 81 are used to position knife carrier 54 and first cutting edge 52 relative to support plates 56 and 58 and movable knife assembly 40 and its associated cutting edge 42. As best shown in FIGS. 3 and 4, each adjusting screw 81 extends through its respective adjusting beam 82 and stationary beam 84. A pair of bolts 86 and their associated nuts 88 are used to secure each stationary beam 84 between support plates 56 and 58. During normal operation of ram baler 20, stationary beams 84 remain fixed relative to support plates 56 and 58.

Each adjusting beam 82 preferably includes three vertical holes extending therethrough. The center vertical hole in each adjusting beam 82 is threaded to receive its associated adjusting screw 81. Smaller vertical holes are positioned on opposite sides of each adjusting screw 81 to allow installation of bolts 92 therethrough. During normal operation of ram baler 20, bolts 92 are used to secure each adjusting beam 82 with its associated stationary beam 84. Bolts 92 are preferably selected to fail in tension if the vertical forces applied to first cutting edge 52 and/or knife carrier 54 exceed a preselected value. Bolts 92 are sometimes referred to as safety bolts. As will be explained later in more detail, shearing or parting bolts 92 will result in shutting down ram baler 20 if the vertical forces apply to knife carrier 54 and/or first cutting edge 52 exceed safe operating limits.

Adjusting screws 81 extend through adjusting beam 82 and stationary beam 84 to contact the upper surface of knife carrier 54. A hardened flat surface 110 is preferably attached to knife carrier 54 for engagement with the end of each adjusting screw 81.

Limit switches 100 are preferably secured to each adjusting beam 82 with a plunger 102 that contacts stationary beam 84. Electrical wiring (not shown) extends from each limit switch 100 to the control system (not shown) for ram baler 20. Limit switch 100 is positioned such that as long as adjusting beam 82 is securely engaged with stationary beam 84, plunger 102 will keep limit switch 100 in its closed position to allow operation of ram baler 20. If either set of bolts 92 should part, their associated adjusting beam 82 will move vertically relative to the associated stationary beam 84. This movement causes the respective limit switch 100 to open and stop the operation of ram baler 20.

Nuts 94 are preferably welded near the top of each adjusting screw 81 to allow rotation of the respective adjusting screw 81 within its associated adjusting beam 82. The cooperation between the threads on the exterior of each adjusting screw 81 and the interior of its associated adjusting beam 82 results in vertical movement of each adjusting screw 81 relative to support plates 56 and 58.

Locking nuts 96 are provided on the portion of each adjusting screw 81 between nut 94 and the top of the associated adjusting beam 82. Locking nuts 96 are used to secure the position of each adjusting screw 81 relative to its adjusting beam 82. A plurality of washers 98 are provided to position their associated locking nut 96 above bolts 92. Thus, locking nuts 96 are in a position which is easy for engagement with a wrench when it is necessary to readjust the vertical position of knife carrier 54 and first cutting edge 52 relative to movable knife assembly 40.

As the vertical spacing between first cutting edge 52 and second cutting edge 42 increases, an appropriate wrench may be engaged with nuts 94 on adjusting screws 81 to reestablish the desired vertical spacing between cutting edges 52 and 42. Since supporting beam 84 and adjusting beam 82 are secured to support plates 56 and 58, rotation of adjusting screw 81 by nut 94 results in vertical movement of adjusting screw 81 which contacts its associated hardened surface 110 to move knife carrier 54 vertically. The force applied to knife carrier 54 from adjusting screws 81 will compress spring washers 76 and allow hanger bolt 74 to move vertically within hanger beam 72. Thus, the vertical positioning of knife carrier 54 can be adjusted by simply rotating adjusting screws 81 without disassembling any of the components of fixed knife assembly 50.

An important feature of the present invention is providing a pair of adjusting screws 81 on opposite sides of hanger assembly 70. If the wear on first cutting edge 52 and second cutting edge 42 is uniform, both adjusting screws 81 may be rotated the same amount to vary the vertical spacing between the cutting edges 52 and 42. However, if uneven wear should occur on either cutting edge 52 or 42 or other components of ram baler 20, the appropriate adjusting screw 81 may be rotated more than the other adjusting screw 81 to compensate for this. uneven wear. Problems with uneven wear may occur in other components such as floor 34 or platen 31 in addition to cutting edges 52 and 42.

An alternative configuration for fixed knife assembly 50 would be to provide only one adjusting assembly 80 located at approximately the same position as hanger assembly 70 and a pair of hanger assemblies 70 on opposite sides of the single adjusting assembly 80. This alternative configuration would essentially be the same as shown in FIG. 3, except for having only one adjusting assembly 80 in place of hanger assembly 70 and two hanger assemblies 70 in place of each adjusting assembly 80. This configuration would have only a limited capability to accommodate for uneven wear between cutting edges 52 and 42.

As previously discussed, in the event of excessive vertical force applied to first cutting edge 52 and/or knife carrier 54, bolts 92 are designed to part under tension above a preselected value. If desired, bolts 86 could also be designed to shear to release the associated supporting beam 84 from its attachment between support plates 56 and 58. In this alternative configuration, limit switches 100 would be repositioned to detect the movement of the associated supporting beam 84 relative to support plates 56 and 58. This type of alternative configuration for the safety shut down system may be preferred for some types of two ram balers. However, the ability to predict failure of bolts or screws in vertical tension is generally more reliable than predicting failure of bolts or screws subject to horizontal shear. Therefore, for many applications of the present invention, bolts 92 which fail in tension above a preselected value will be used to release adjusting beam 82 from its associated support beam 84.

For some types of ram bales, only one support plate may be required for the fixed knife assembly. Either first support 56 or second support plate 58 may be eliminated, depending upon the specific baler design. Using both support plates 56 and 58 provides better protection for the various components of knife assembly 50 and improved reliability in harsh, rugged operating environments. In the same manner adjusting assembly 80 could be modified to combine the functions of adjusting beam 82 and support beam 84 into a single component. However, the use of separate adjusting beams 82 and support beams 84 provides improved reliability for use with many ram baler designs.

Although the present invention and its advantages have been described in detail, it should be understood that various changes, substitutions and alterations can be made therein without departing from the spirit and scope of the invention as defined by the following claims.

What is claimed is:

1. A ram baler for compressing material comprising:
a compression ram within the ram baler;
a first knife assembly attached to the compression ram for movement with the compression ram to cut the material;
a second knife assembly attached to the ram baler for cutting the material in cooperation with the first knife assembly;
the second knife assembly vertically spaced from the first knife assembly;
the second knife assembly having a knife carrier and means for adjusting the vertical spacing between the knife carrier and the first knife assembly;
a first support plate and a second support plate for use in attaching the second knife assembly to the ram baler;
the knife carrier movably positioned between the first support plate and the second support plate with the first support plate and the second support plate disposed on opposite sides of the knife carrier; and
a first cutting edge secured to the knife carrier.

2. The ram baler as defined in claim 1, wherein the means for adjusting the vertical spacing of the knife carrier further comprises:
a pair of adjusting assemblies disposed between the first support plate and the second support plate; and
the pair of adjusting assemblies engaged with the knife carrier.

3. A ram baler for compressing material comprising:
a compression ram within the ram baler;
a first knife assembly attached to the compression ram for movement with the compression ram to cut the material;
a second knife assembly attached to the ram baler for cutting the material in cooperation with the first knife assembly;
the second knife assembly vertically spaced from the first knife assembly;
the second knife assembly having a knife carrier and means for adjusting the vertical spacing between the knife carrier and the first knife assembly;
a first support plate and a second support plate for attaching the second knife assembly to the ram baler;
the knife carrier movably positioned between the first support plate and the second support plate;
a cutting edge secured to the knife carrier;
a hanger assembly disposed between the first support plate and the second support plate; and
means for attaching the knife carrier to the hanger assembly.

4. The ram baler as defined in claim 3, wherein the means for attaching the knife carrier to the hanger assembly further comprises:
a hanger beam disposed between the first support plate and the second support plate;
a hanger bolt extending through the hanger beam; and
means for attaching one end of the hanger bolt to the knife carrier.

5. The ram baler as defined in claim 4, wherein the hanger assembly further comprises:
the other end of the hanger bolt extending through the hanger beam opposite from the knife carrier;
a first shoulder disposed on the exterior of the hanger bolt with the first shoulder located between the other end of the hanger bolt and the hanger beam; and
biasing means disposed on the exterior of the hanger bolt between the first shoulder and the hanger beam.

6. A ram baler for compressing material comprising:
a compression ram within the ram baler;
a first knife assembly attached to the compression ram for movement with the compression ram to cut the material;
a second knife assembly attached to the ram baler for cutting the material in cooperation with the first knife assembly;
the second knife assembly vertically spaced from the first knife assembly;
the second knife assembly having a knife carrier and means for adjusting the vertical spacing between the knife carrier and the first knife assembly;
a first support plate and a second support plate secured to the ram baler;
a pair of supporting beams disposed between the first support plate and the second support plate with the supporting beams located near the respective ends of the first support plate and the second support plate;
an adjusting beam secured to each support beam; and an adjusting screw extending through its associated adjusting beam and support beam with one end of each adjusting screw contacting the knife carrier.

7. The ram baler as defined in claim 6, further comprising a threaded connection between the exterior of each adjusting screw and the interior of its associated adjusting beam for translating rotation of the adjusting screws into vertical movement of the adjusting screws relative to the first and second support plates and the knife carrier.

8. The ram baler as defined in claim 6, further comprising:

a safety bolt engaging each adjusting beam with its associated support beam;

limit switches positioned to detect movement of the adjusting beams relative to their associated support beams and for stopping operation of the ram baler in response to such movement of the adjusting beams; and the safety bolt selected to allow movement of the adjusting beams relative to their associated support beam when forces applied to the knife carrier exceed a preselected value.

9. A knife assembly for use with ram balers comprising:

a first support plate and a second support plate for use in attaching the knife assembly to the ram baler;

a knife carrier movably positioned between the first support plate and the second support plate with means for allowing limited vertical movement of the knife carrier relative to the first support plate and the second support plate;

the first support plate and the second support plate disposed on opposite sides of the knife carrier;

a cutting edge secured to the knife carrier; and means for adjusting the vertical position of the knife carrier relative to the first support plate and the second support plate.

10. The knife assembly as defined in claim 9, wherein the means for adjusting the vertical position of the knife carrier further comprises a pair of adjusting assemblies disposed between and secured to the first support plate and the second support plate.

11. A knife assembly for use with ram balers comprising:

a first support plate and a second support plate for use in attaching the knife assembly to the ram baler;

a knife carrier movably positioned between the first support plate and the second support plate with means for allowing limited vertical movement of the knife carrier relative to the first support plate and the second support plate;

a cutting edge secured to the knife carrier;

means for adjusting the vertical position of the knife carrier relative to the first support plate and the second support plate;

a hanger assembly disposed between the first support plate and the second support plate; and means for attaching the knife carrier to the hanger assembly.

12. The knife assembly as defined in claim 11, wherein the means for attaching the knife carrier to the hanger assembly further comprises:

a hanger beam disposed between the first support plate and the second support plate;

a hanger bolt extending through the hanger beam; and means for attaching one end of the hanger bolt to the knife carrier.

13. The knife assembly as defined in claim 12, wherein the hanger assembly further comprises:

the other end of the hanger bolt extending through the hanger beam opposite from the knife carrier;

a first shoulder disposed on the exterior of the hanger bolt with the first shoulder located between the other end of the hanger bolt and the hanger beam; and biasing means disposed on the exterior of the hanger bolt between the first shoulder and the hanger beam.

14. A knife assembly for use with ram balers comprising:

a support plate for use in attaching the knife assembly to the ram baler;

a knife carrier secured to the support plate with means for allowing limited vertical movement of the knife carrier relative to the support plate;

a cutting edge secured to the knife carrier;

means for adjusting the vertical position of the knife carrier relative to the support plate;

a pair of adjusting assemblies secured to the support plate;

a pair of supporting beams adjacent the ends of the support plate;

an adjusting beam secured to each support beam; and each adjusting screw extending through its associated adjusting beam and support beam with one end of each adjusting screw contacting the knife carrier.

15. The knife assembly as defined in claim 14, further comprising a threaded connection between the exterior of each adjusting screw and the interior of its associated adjusting beam for translating rotation of the adjusting screw into vertical movement of the adjusting screws relative to the support plate.

16. The knife assembly as defined in claim 14, further comprising:

a pair of safety bolts engaging each adjusting beam with its associated support beam;

limit switches positioned to detect movement of the adjusting beams relative to their associated support beams and for stopping operation of the ram baler in response to such movement of the adjusting beam; and the safety bolts selected to allow movement of the adjusting beams relative to their associated support beams when forces applied to the knife carrier exceed a preselected value.

17. A ram baler having a compression ram with a first knife assembly attached thereto for movement within the ram baler, and a second knife assembly attached to the ram baler, further comprising:

the second knife assembly vertically spaced from the first knife assembly;

the second knife assembly having a knife carrier with a first cutting edge secured to the knife carrier;

means for adjusting the vertical spacing between the knife carrier and the first knife assembly while the second knife assembly remains secured to the ram baler;

a first support plate and a second support plate for use in attaching the knife assembly to the ram baler; and the knife carrier secured between the first support plate and the second support plate with means for allowing limited vertical movement of the knife carrier relative to the first support plate and the second support plate.

18. The ram baler as defined in claim 17, wherein the means for adjusting the vertical spacing of the knife carrier further comprises a pair of adjusting assemblies secured to the first support plate and the second support plate.

19. A ram baler having a compression ram with a first knife assembly attached thereto for movement within the ram baler, and a second knife assembly attached to the ram baler, further comprising:

the fixed knife assembly vertically spaced from the movable knife assembly;

the fixed knife assembly having a knife carrier with a first cutting edge secured thereto;

means for adjusting the vertical spacing between the knife carrier and the movable knife assembly while the fixed knife assembly remains secured to the ram baler;

a support plate for use in attaching the knife assembly to the ram baler;

the knife carrier secured to the support plate with means for allowing limited vertical movement of the knife carrier relative to the support plate;

a pair of adjusting assemblies secured to the support plate;

a pair of supporting beams adjacent the ends of the support plate;

an adjusting beam secured to each support beam;

an adjusting screw extending through its associated adjusting beam and support beam with one end of each adjusting screw contacting the knife carrier;

a threaded connection between the exterior of each adjusting screw and the interior of its associated adjusting beam for translating rotation of the adjusting screw into vertical movement of the adjusting screws relative to the support plate and the knife carrier.

20. The ram baler as defined in claim 19, further comprising:

a pair of safety bolts engaging each adjusting beam with its associated support beam;

limit switches positioned to detect movement of the adjusting beams relative to their associated support beams and for stopping operation of the ram baler in response to such movement; and the safety bolts selected to allow movement of the adjusting beams relative to their associated support beams when forces applied to the knife carrier exceed a preselected value.

* * * * *